United States Patent [19]

Prien et al.

[11] Patent Number: 4,822,254

[45] Date of Patent: Apr. 18, 1989

[54] OSCILLATING CYLINDER PUMPING ARRANGEMENT

[75] Inventors: Walter F. Prien, Dyer, Tenn.; Meredith W. Meece; John H. Bolthouse, II, both of Ouachita, La.

[73] Assignee: TI Pneumotive, Inc., Louisville, Ky.

[21] Appl. No.: 101,735

[22] Filed: Sep. 28, 1987

Related U.S. Application Data

[63] Continuation of Ser. No. 717,979, Mar. 29, 1985, abandoned.

[51] Int. Cl.[4] ..... F01B 15/00; F04B 35/04

[52] U.S. Cl. ..... 417/368; 92/117 R; 417/460; 417/410

[58] Field of Search ..... 417/460, 461, 464, 410, 417/368; 137/512, 855, 856; 92/117 R

[56] References Cited

U.S. PATENT DOCUMENTS

| | | | |
|---|---|---|---|
| 1,181,318 | 5/1916 | Kellogg | 417/460 |
| 1,414,573 | 5/1922 | Krehlik | 417/464 X |
| 1,611,849 | 12/1926 | Chapman | 417/460 |
| 2,168,036 | 8/1939 | Maniscalco | 417/460 X |
| 2,287,360 | 6/1942 | Sappington | 417/460 |
| 2,433,812 | 12/1947 | Hastings et al. | 417/460 |
| 3,320,902 | 5/1967 | Paschke | 417/510 |
| 3,372,863 | 3/1968 | Bloom | 417/372 |
| 3,476,308 | 11/1969 | Rundell et al. | 417/460 |
| 3,679,333 | 7/1972 | Zoppi | 137/512 X |
| 3,998,243 | 12/1976 | Osterkorn et al. | 137/856 |
| 4,044,745 | 8/1977 | Brinkman et al. | 417/460 X |
| 4,283,167 | 8/1981 | Bassar et al. | 418/101 |
| 4,368,010 | 1/1983 | Kohlhauer et al. | 417/238 |
| 4,527,460 | 7/1985 | Eisenbacher | 417/460 X |

*Primary Examiner*—William L. Freeh

*Attorney, Agent, or Firm*—Hill, Van Santen, Steadman & Simpson

[57] ABSTRACT

A pumping arrangement includes an electric motor which has an output shaft having a shaft portion that projects out of the stator of the motor, a crankcase which surrounds the shaft portion and includes an outwardly projecting piston component that is stationary with respect to the motor stator, a cylinder component which is arranged around the piston component, an eccentric element which is mounted on the shaft portion for rotation therewith, an annular force-transmitting element which surrounds the eccentric element, and two connecting units which connect the cylinder component with the force-transmitting element at the opposite sides of the piston component and cause the cylinder component to perform a reciprocating and oscillating movement on the piston component as the force-transmitting element is moved eccentrically with respect to the longitudinal axis of the output shaft by the eccentric element. An impeller mounted on the shaft portion for joint rotation therewith causes ambient air to flow around the cylinder and piston components and thus cool the same. Two reed valves are mounted on a valve plate secured to the piston component and control the flow of the fluid through respective admitting and discharging ports provided in the valve plate.

6 Claims, 3 Drawing Sheets

OSCILLATING CYLINDER PUMPING ARRANGEMENT

This is a continuation of application Ser. No. 717,979, filed Nov. 29, 1985 now abandoned.

BACKGROUND OF THE INVENTION

The present invention relates generally to pumping arrangements, and more particularly to pumping arrangements with stationary pistons and movable cylinders.

There are already known various constructions of pumping arrangements with stationary pistons and movable cylinders. Examples of such pumping arrangements can be found, for instance, in U.S. Pat. Nos. 661,938 and 3,236,190. However, in the known constructions, the cylinders reciprocate along a straight line. This makes the construction of the respective pumping arrangement rather complex, with substantial reciprocating masses. Therefore, such known constructions are not suited for use as energy-efficient small pumps.

On the other hand, there are also already known, for instance, from U.S. Pat. Nos. 3,961,868, 3,961,869, 4,028,015 and 4,275,999, mini-compressors with stationary cylinders and movable pistons, the respective piston being driven by an eccentric element mounted on the output shaft of an electric motor into reciprocation and angular displacement or wobbling in the respective cylinder. However, in these known constructions, both the cylinder and the piston are received in the interior of a crankcase, at a location outside the flow path of cooling air through the interior of the electric motor and the crankcase. Therefore, the cylinder and piston are very ineffectively cooled, if at all, in such known constructions. This brings about the disadvantage that the sealing element, such as a cup-shaped seal that is mounted on the piston and sealingly contacts the cylinder, is subject to a high degree of wear, since the wear rate is proportional to the operating temperature of the seal and thus of the cylinder and the piston. Moreover, these known constructions are hardly amenable to field servicing, since the entire assembly must be disassembled before access can be had to the parts which need periodic servicing or replacement, such as the sealing element.

SUMMARY OF THE INVENTION

Accordingly, it is a general object of the present invention to avoid the disadvantages of the prior art.

More particularly, it is an object of the present invention to provide a pumping arrangement which does not possess the disadvantages of the above-discussed pumping arrangements.

Still another object of the present invention is so to construct the pumping arrangement of the type here under consideration as to be particularly suited for use as a mini-compressor, especially but not exclusively for medical uses, such as in oxygen concentrators.

It is yet another object of the present invention so to design the pumping arrangement of the above type as to improve the cooling of the various components thereof and thus to prolong the useful life of such components.

An additional object of the present invention is to devise a pumping arrangement of the above type which would be relatively light-weight and would include a minimum amount of moving masses.

A concomitant object of the present invention is to develop a pumping arrangement that is relatively simple in construction, inexpensive to manufacture, easy to use, and reliable in operation nevertheless.

A still further object of the present invention is to provide a basic construction of the pumping arrangement of the above type which is easily adaptable to a variety of uses by making merely slight modifications of the basic construction.

In pursuance of these objects and others which will become apparent hereafter; one feature of the present invention resides in a pumping arrangement comprising a motor having a stator and at least one output shaft centered on a longitudinal axis and including at least one shaft portion projecting axially out of said stator; at least one crankcase stationary with respect to said stator and arranged around said shaft portion; at least one piston component rigid with and extending outwardly of said crankcase along a reciprocation axis extending substantially normal to said longitudinal axis; at least one cylinder component arranged around said piston component and bounding a pumping chamber with said piston component; means for sealing the interface between said piston and cylinder components; means for admitting a fluid being pumped into and for discharging such fluid from said pumping chamber; valve means operative for controlling the flow of the fluid being pumped through said admitting and discharging means; eccentric means mounted on said shaft portion and centered on an eccentric axis substantially parallel to and transversely offset from said longitudinal axis and orbiting about said longitudinal axis during the rotation of said shaft portion with attendant eccentric movement of said eccentric means about said longitudinal axis; and means for connecting said eccentric means with said cylinder component to cause said cylinder component to share in said eccentric movement of said eccentric means and thus to conduct a reciprocating and tilting oscillating movement with respect to said piston component.

An important advantage of the pumping arrangement of this construction is that both the cylinder component and the piston component are arranged at the exterior of the crankcase, that is, at a location at which heat dissipation into the ambient atmosphere is pronounced, and that the reciprocating and tilting oscillating movement of the cylinder component further improves the cooling effect. This is especially advantageous when, in accordance with another advantageous aspect of the present invention, there is provided an impeller that impels the ambient air to flow around the exterior of the crankcase and thus around the cylinder and piston components. Moreover, those components of the pumping arrangement which need occasional servicing or replacement, such as the sealing means, can be easily accessed in field without having to completely disassemble the pumping arrangement by merely dismounting the cylinder component.

BRIEF DESCRIPTION OF THE DRAWING

Above-mentioned and other features and objects of this invention will become more apparent by reference to the following description taken in conjunction with the accompanying drawing, in which.

DETAILED DESCRIPTION OF THE PREFERRED EMBODIMENTS

Figure 1:
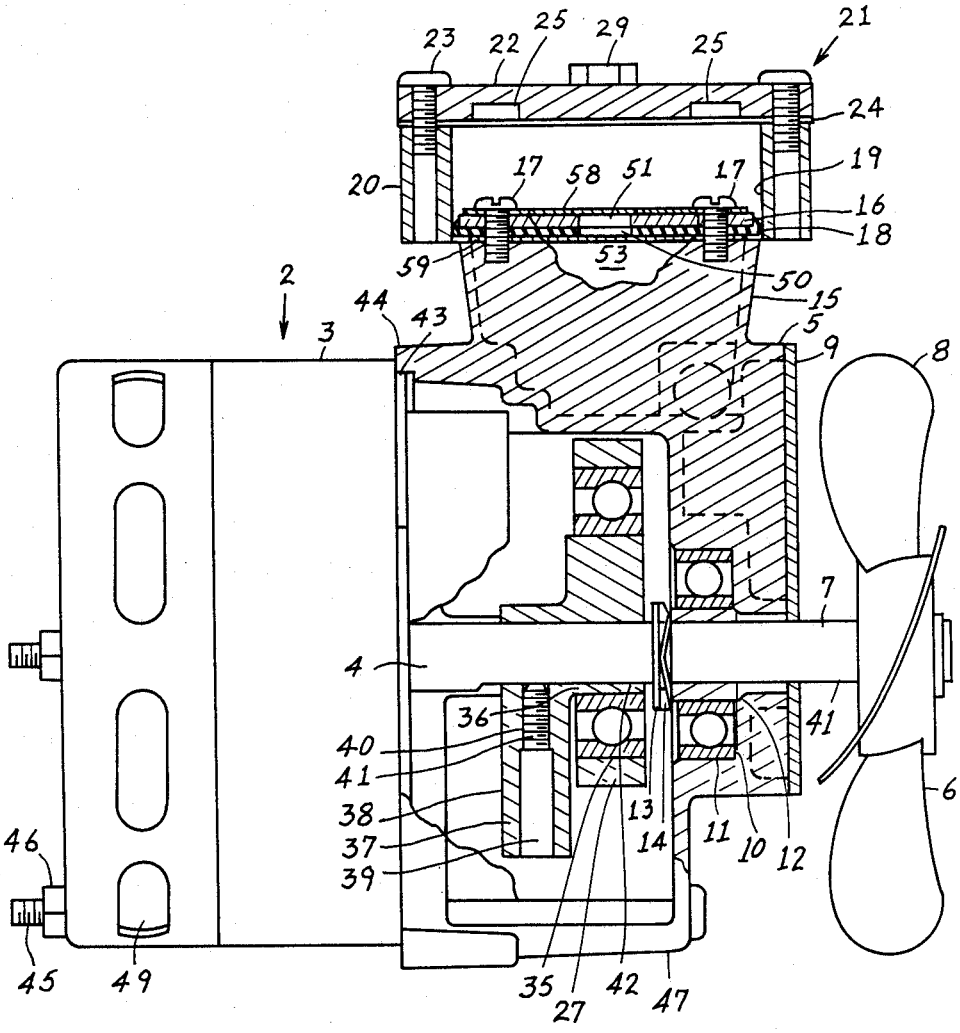
FIG. 1 is a partially sectioned side elevational view of a pumping arrangement according to the present invention.

Referring now to the drawing in detail, and first to FIG. 1 thereof, it may be seen that the reference numeral 1 has been used therein to identify, in its entirety, a pumping arrangement constructed in accordance with the present invention. The pumping arrangement 1 is especially suited, and is intended to be used, for pumping gaseous media, particularly air. The pumping arrangement 1 includes an electric motor which is generally identified by the reference numeral 2 and which is of a conventional construction so that no details thereof need be, nor will they be, disclosed here. Suffice it to say that the electric motor 2 includes a stator part 3 which may but need not include a separate housing and which accommodates the rotor part of the electric motor 2, and that the rotor part of the electric motor 2 includes an output shaft 4 which extends at least in one axial direction out of the stator part 3 of the electric motor 2.

This output shaft 4 extends into and through the interior of a crankcase 5. The crankcase 5 is preferably made of cast aluminum. The output shaft 4 has a fan or impeller 6 of a conventional construction mounted for joint rotation therewith on its portion 7 that extends beyond the crankcase 5. During the rotation of the output shaft 4, the impeller 6 will impel ambient air either toward or away from the crankcase 5, depending on the sense of rotation of the output shaft 4 relative to the pitch of impeller blades 8 of the impeller 6. In either case, the impeller 6 will cause air to flow substantially axially both through the interior and around the exterior of the pumping arrangement 1, to cool the same. It is currently preferred that the arrangement 1 be so constructed and operated that the impeller 6 forces the ambient air to flow toward the crankcase 5.

The crankcase 5 includes a support portion 9 which has a recess 10 that accommodates a bearing 11 which is preferably of the anti-friction type, as shown, of the ball bearing type. The bearing 11 rotatably supports the output shaft 4 of the electric motor 2 in the support portion 9 of the crankcase 5, at the "outboard" end portion of the output shaft 4, that is, at a location remote from the electric motor 2. The mounting of the output shaft 4 in the bearing 11 situated at this remote location significantly reduces the amount of wear of the various components of the pumping arrangement 1, as well as the amount of noise generated by the pumping arrangement 1 during its operation. The bearing 11 is mounted on a sleeve 12 that is carried by the output shaft 4 and rotates therewith, but is displaceable axially thereof. The inner race of the ball bearing 11 is mounted on the sleeve 12 in a manner which prevents, or substantially prevents, any relative movement between the inner race and the sleeve 12. The shaft 4 is provided with a radially outwardly projecting collar 13 which is rigid with the output shaft 4. The collar 13 is preferably constituted by a split resilient ring which is partially received in a circumferential groove provided in the output shaft 4, as is well known. A Belleville washer or a similar spring element 14 is carried by the output shaft 4 between the collar 13 and the sleeve 12. The spring element 14 resiliently pushes the collar 13 and the sleeve 12 in opposite axial directions apart from one another. Since the inner race of the bearing 11 is rigidly connected to the sleeve 12, the force of the spring 14 that acts on the sleeve 12 will be transmitted by the latter to the inner race of the bearing 11. Then, via the ball elements of the ball bearing 11, this force will be applied to the outer race of the bearing 11, thus always assuring proper seating of the bearing 11 in the recess 10.

The crankcase 5 further includes an outwardly projecting portion 15 which, as will be explained later, serves as a piston component of a pumping unit of the pumping arrangement 1. The portion 15 is shown to have an outwardly diverging frusto-conical configuration. The reason for such a frusto-conical configuration, or for a configuration that diverges outwardly at least as considered in a plane normal to that of FIG. 1, will become apparent later. The crankcase 5 inclusive of the projection 15 is so configurated as to be able to machine those surfaces thereof which need machining on the same machine and in the same set-up. A valve plate 16 is connected to the portion 15 of the crankcase 5 by respective connecting elements 17 which are illustrated as screws with slotted heads. A sealing between element 18 which is cup-shaped at least in its illustrated condition of use is interposed between the valve plate 16 and the portion 15 of the crankcase 5 and seals the interface therebetween. The sealing element 18 extends outwardly beyond the portion 15 and into sealing contact with an internal surface 19 of a circumferential wall portion 20 of a cylinder component 21 of the pumping arrangement 1 that is situated radially outwardly of the portion 15 and circumferentially completely surrounds the latter.

The cylinder component 21 further includes an end wall portion 22 which is shown to be separate from the circumferential wall portion 20 and to be connected thereto by means of screws 23 or similar fastening elements. A sealing gasket 24 is interposed between the upper end face of the circumferential wall portion 20 and the lower surface of the corresponding marginal region of the end wall portion 22, as considered in the illustrated position. The end wall portion 22 has recesses 25 which are substantially aligned with the respective connecting elements 17 and are capable of receiving the heads of such connecting elements 17 with clearance in a non-illustrated lower position of the cylinder component 21.

Figure 2:
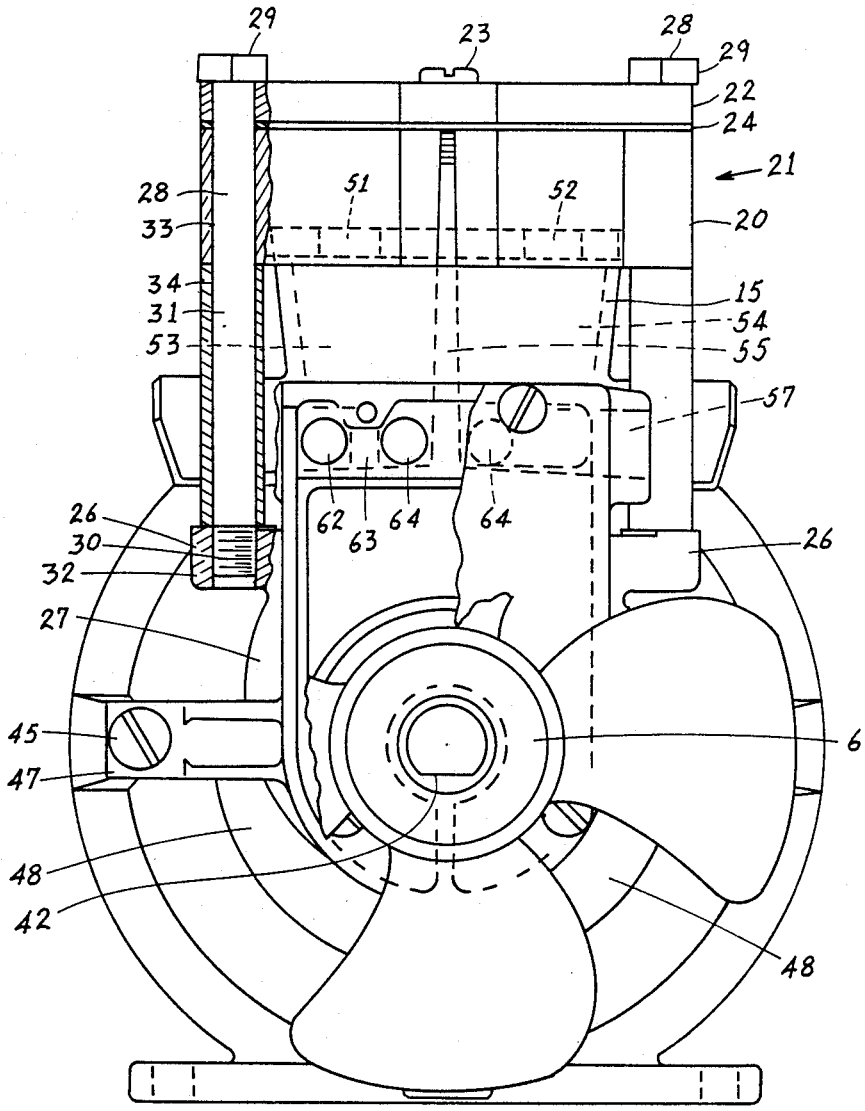
FIG. 2 is a partially sectioned axial end view of the pumping arrangement of FIG. 1.

As shown particularly in FIG. 2 of the drawing, the cylinder component 21 is mediately connected, at each of the two opposite sides of the portion 15 of the crankcase 5, to a lug or ear 26 which constitutes an intergral part of a sleeve-shaped force-transmitting element 27. As illustrated at the left-hand region of FIG. 2, this mediate connection is accomplished on each side by means of a threaded fastening element or bolt 28 which has a head 29 and an externally threaded portion 30 at least at that end region of its shank 31 that is remote from the head 29, this externally threaded portion 30 meshingly engaging an internal thread provided in an associated bore 32 of the respective ear or lug 26 of the associated force-transmitting element 27. The shank 31 freely passes through a respective bore 33 that is provided therefor in the circumferential wall portion 20 of the cylinder component 21. Furthermore, a tubular spacing element 34 surrounds that portion of the shank 31 which is situated between the circumferential wall portion 20 and the respective ear or lug 26, being confined therebetween upon tightening of the threaded fastening element 28. As will become apparent hereafter, the character of the stroke of the cylinder-and-piston arrangement 21 and 15 of the present invention, and especially the positioning of the cylinder component 21 with respect to the projection 15 that constitutes the piston component, can be changed within certain limits by merely substituting tubular spacing elements 34 and/or fastening elements 28 of different lengths for those previously used.

Turning now back to FIG. 1 of the drawing, it may be seen that the aforementioned force-transmitting element 27 has a generally annular configuration, with the ears or lugs 26 obviously extending outwardly beyond this general outline. The force-transmitting element 27 is shown to be mounted on another bearing 35, which is again illustrated as being of the ball-bearing anti-friction type. In this case, the force-transmitting element 27 is mounted on the outer race of the ball bearing 35 in a manner preventing any displacement between these parts, such as by using an interference fit. The inner race of the ball bearing 35 is, in turn, mounted on an eccentric element 36 which is mounted on the output shaft 4 of the electric motor 2 and is caused, in a manner yet to be described, to jointly rotate with the output shaft 4. Here again, it is advantageous when the mounting of the inner race of the ball bearing 35 on the eccentric element 36 is such that no displacement can or does take place between these parts in any direction during the operation of the pumping arrangement 1. Once more, interference fit is an acceptable and currently preferred way of accomplishing this purpose.

The eccentric element 36 has a substantially cylindrical cross section and is centered on an eccentric axis that is parallel to but transversely offset from the longitudinal axis of the output shaft 4. Therefore, as the output shaft 4 rotates, the eccentric axis of the eccentric element 36 orbits the longitudinal axis of the output shaft 4 and the force-transmitting element 27 conducts corresponding eccentric movements. However, the freedom of movement of the force-transmitting element 27 is constrained by the fact that the force-transmitting element 27 is connected by the threaded fastening elements 28 and the tubular spacing elements 34 to the cylinder component 21 and that the portion 15 of the crankcase 5, which is stationary, extends into the interior of the cylinder component 21, so that the force-transmitting element 27 will conduct merely an a reciprocating and tilting oscillating movement on the eccentric element 36 and this oscillating movement will be shared by the fastening elements 28, the tubular spacing elements 34 and ultimately the cylinder component 21.

FIG. 1 also illustrates that the eccentric element 36 forms an integral part of a mounting member 37 which further includes a counterweight element 38 which also constitutes an integral portion of the mounting member 37, that is, it is integral with the eccentric element 36. The counterweight element 38 is so configurated and dimensioned in a well-known manner as to dynamically counterbalance or compensate for any otherwise dynamically unbalanced inertial forces of the moving masses. The counterweight element 38 is provided with an opening 39 which is threaded at its portion 40 that is closest to the shaft 4. A set screw 41 is threaded into this threaded portion 40 of the opening 39 and engages the output shaft 4 to prevent displacement of the mounting member 37 at least in the axial direction.

As a comparison of FIG. 1 and 2 with one another will reveal, the output shaft 4 is non-circular, that is, it has a flat surface 42 that cooperates with respective similarly or complementarily cross-sectionally configurated regions at least of the hub of the impeller 6 and of the sleeve 12, and advantageously also of the mounting member 37. When the output shaft 4 is configurated in this manner, the tip of the set screw 41 engages this flat surface 42 and prevents the mounting member 37 from conducting movements relative to the output shaft 4 at least in the axial directions of the latter. Then, when the mounting member 37 is interiorly configurated compatibly or complementarily to the non-circular outline of the output shaft 4, the cooperation of the flat surface 42 with the corresponding internal region of the mounting member 37 will prevent relative angular displacement of the mounting member 37 with respect to the output shaft 4 about the longitudinal axis of the output shaft 4.

The bearing 35, and preferably also the bearing 11, is of the permanently lubricated type, that is, prior to the installation thereof, it is filled with grease or a similar lubricant and then it is sealed to prevent the lubricant from escaping therefrom. Bearings of this kind are well known in the art and hence the sealing arrangements which seal the lubricant in the respective bearing 35 or 11 have not been shown in the drawing.

FIGS. 1 and 2 taken together further indicate how the crankcase 5 may be positionally fixed with respect to the stator part 3 of the electric motor 2. To this end, the stator part 3 of the electric motor 2 is shown to have a circumferentially extending radially inwardly offset stepped groove 43, and the crankcase 5 is shown to have a rim 44 which is partially received in the stepped groove 43 and hence radially surrounds the stator part 3 at this region. This positionally fixes the crankcase 5 relative to the stator part 3 in the radial directions, but not necessarily in the circumferential or axial directions. Such circumferential and axial fixation is accomplished or enhanced by bolts or similar connecting elements 45 shown to cooperate with associated nuts 46. The bolts 45 pass through respective openings in bridge-like portions 47 of the crankcase 5, and through corresponding openings in the electric motor stator part 3 of the electric motor 2. The bridge-like portions 47 leave spaces 48 therebetween through which the air impelled by the impeller 6 can enter the interior of the crankcase 5 and then flow through this interior and through the interior of the electric motor 2 eventually to leave the stator part 3 of the latter through non-illustrated openings provided in the end wall of the stator part 3 and/or through illustrated openings 49 provided in the circumferential wall of the stator part 3, or leave the interior of the crankcase 5 and flow toward the impeller 6 after having been drawn into and through the interiors of the stator part 3 and of the crankcase 5 in a direction opposite to that described above, depending on the axial direction in which the impeller 6 impels the air. In either case, the flow of air through the interior of the crankcase 5 will cool at least the eccentric element 36 and the force-transmitting element 27, as well as the bearing 35 which is interposed therebetween.

It may also be seen in FIG. 1 of the drawing that the sealing element 18 has at least one opening 50 therein. The opening 50 registers with two ports 51 and 52 provided in the valve plate 16. Only the port 51 is shown in FIG. 1, the port 52 being located behind the port 51 and thus being obscured thereby in this Figure. However, both ports 51 and 52 are indicated in FIG. 2 and in FIG.

4. Depending on the particular construction and use of the pumping arrangement 1, that is, whether superatmospheric or subatmospheric pressure is the useful output of the pumping arrangement 1, and on the desired locations of the inlet and outlet openings of the respective pumping arrangement 1, one of the ports 51 and 52 serves as a discharge port while the other serves as an intake port. In the following discussion, it will be assumed that the port 51 is to serve as the intake port and the port 52 as the discharge port. The ports 51 and 52 communicate with respective compartments, conduits or ducts that establish communication with the remainder of the fluid-flow circuitry in which the pumping arrangement 1 is being used, and that will not be discussed here in any great detail beyond what is necessary for understanding the structure and operation of the pumping arrangement 1.

As may be seen from a comparison of FIGS. 1 and 2 with one another, the port 51 communicates with a compartment 53 and the port 52 communicates with a compartment 54, the compartments 53 and 54 being provided in the crankcase 5 and being separated from one another by a partitioning wall 55. The sealing element 18 is in a sealing contact with the partitioning wall 55 and thus effectively sealingly separates the compartments 53 and 54 from one another. As illustrated particularly in FIG. 3, the compartment 53 communicates with the ambient atmosphere through an inlet duct 56, while the compartment 54 communicates with an outlet duct 57 to which a conduit of the aforementioned fluid-flow circuitry is joined, in a manner which is well known in this field and will not be discussed here in any detail. However, it will be appreciated that the duct 56 could so constructed as to be capable of being used to establish communication between the compartment 53 and another part of the fluid-flow circuitry.

Figure 4:
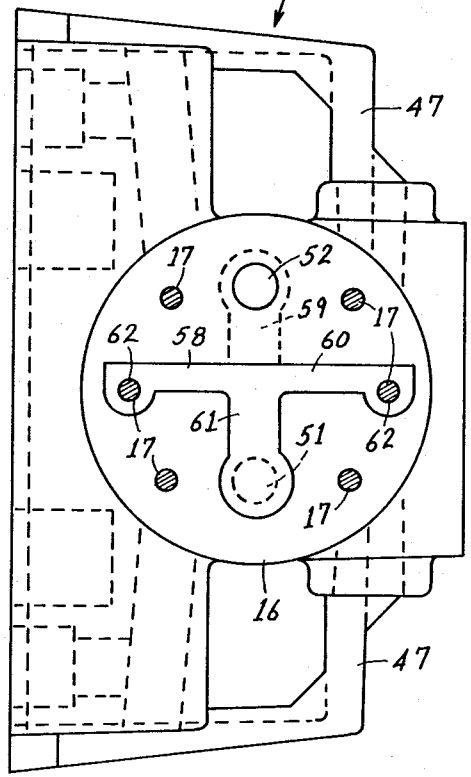
FIG. 4 is a view similar to that of FIG. 3 but with a valve plate and valve elements in place on the piston component of the crankcase.

To control the flow of the fluid being pumped into and out of the pumping space bounded by the cylinder component 21 and the piston component constituted by the portion 15 of the crankcase 5 and the valve plate 16, there are provided two valve elements 58 and 59 which are held in position by two of the screws 17, as may best be seen from comparing FIGS. 1 and 4 with one another. As particularly shown in FIG. 4 for the valve element 58, the valve elements 58 and 59 are constructed as reed valves, that is, they are provided with respective flow-control portions that register with the respectively associated ports 51 and 52 and the areas of the valve plate 16 surrounding the same and can be resiliently deflected therefrom by the pressure differential between the respective compartments 53 and 54 and the aforementioned pumping space. Advantageously, as diagrammatically indicated in FIG. 4 of the drawing for the valve element 58, each of the valve elements 58 and 59 has a substantially T-shaped configuration that includes a horizontal bar 60 and a vertical bar 61 which constitutes the aforementioned flow-control portion. The ends of the horizontal bar 60 have respective apertures 62 for the passage of the stems of the respective screws 17 therethrough. Obviously, in the assembled condition, the screws 17 hold the horizontal bar 60 in place, while the vertical bar 61 is free, to the extent determined by the resiliency of the material of the respective valve element 58 or 59, to deviate from the plane along which the horizontal bar 60 extends and thus from the valve plate 16. It will be appreciated that, prior to the deviation from the aforementioned plane, the vertical bar 61 of the valve element 58 will cover the associated port 51 and substantially or totally obstruct the passage of the fluid being pumped through the port 51, while the vertical bar 61 of the valve element 59 will perform the same function with respect to the port 52. On the other hand, in their respective deflected conditions, the vertical bars 61 of the valve elements 58 and 59 will permit passage of the fluid being pumped through the ports 51 and 52.

What has been described so far constitutes the basic construction of the pump part of the pumping arrangement 1. As already mentioned before, this basic construction of the pump part of the pumping arrangement 1 of the present invention can be adapted for a variety of applications with only slight structural modifications, which makes this basic construction very versatile. To be so modifiable, some of the connecting passages of the pump part of the pumping arrangement 1 which will be discussed below are not provided in the basic construction of the pump part; rather, they are selectively provided in the particular construction of the pump part, depending on the intended use of the latter.

One such particular construction of the pump part of the pumping arrangement 1 is shown in, and will be discussed in connection with, FIG. 3 of the drawing. In this case, the pump part is to be used as a master pump of a tandem combination of two pumps which are arranged at mutually opposite axial ends of the electric motor 2 in this particular construction of the pumping arrangement 1, and the slave pump of which has a different construction, as will be explained later. In this instance, the outlet duct 57 communicates directly with the compartment 54, while the insert duct 54 is configurated as a blind hole which is in communication, via a connecting passage or bore 62, with a pulsation damping space 63. Another passage or bore 64 then connects this pulsation damping space with the compartment 53. Because of this construction, the flow of the air drawn into the inlet duct 56 is diverted or conducted in a tortuous path before reaching the compartment 53, so that pulsations in this flow are damped and the level of the attendant noise is significantly reduced in comparison with the situation where the inlet duct 56 would directly open into the compartment 53.

The crankcase 5 is further provided with two connecting passages 65 and 66 which communicate with the respective compartments 53 and 54 and extend along substantially L-shaped courses to open onto respective regions of an end face of the crankcase 5 that face toward the slave pump part and are situated outside the periphery of the stator 3. The passages 65 and 66 establish communication with the corresponding passages 65 and 66 of the slave pump part which, for the purposes of the present explanation, will be assumed to be arranged as a mirror image of the master pump part, at least as far as the assignment of the reference numerals is concerned. Thus, ambient air will flow from the compartment 53 of the master pump part into the compartment 53 of the slave pump part through a conduit connecting the ends of the passages 65, while compressed air present in the compartment 54 of the slave pump will flow through another conduit connecting the ends of the passages 66 into the compartment 54 of the master pump part, to be discharged therefrom through the outlet duct 57 which is shared by both pump parts. Each of the passages 65 and 66 is sealed off at the region of merger of the two legs of the L-shaped course thereof by a plug 67.

In the slave pump part of this particular construction of the pumping arrangement 1, both the inlet duct 56 and the outlet duct 57 are constructed as blind bores, and at least the communicating passage 62 is absent. However, the communicating passage 64 may be present, as indicated in broken lines in FIG. 2, to establish communication in the slave pump part between the compartment 53 and the pulsation damping space 63. Of course, the connecting passages 65 and 66 are present in the slave pump part. On the other hand, if the pumping arrangement 1 is to include only one pump part, the basic construction of this pump part will be like that disclosed in FIG. 3, except that the connecting passages 65 and 66 will be omitted or sealingly closed.

Figure 3:
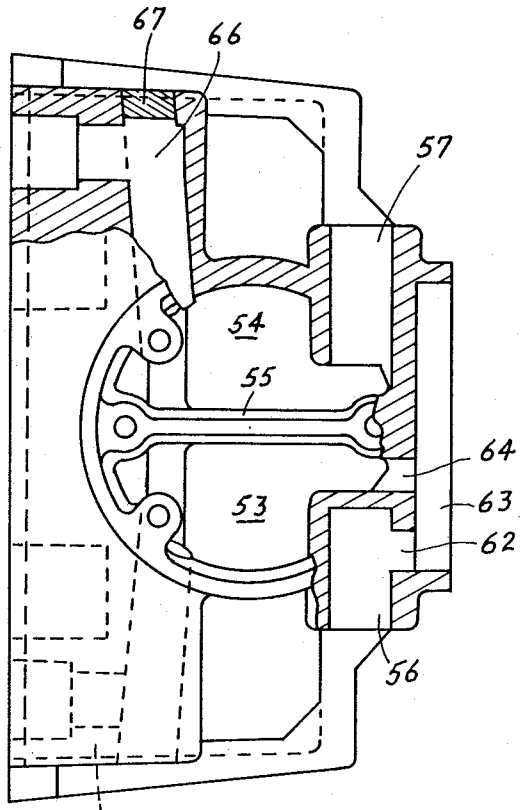
FIG. 3 is a partially sectioned top plan view of the crankcase of the pumping arrangement of FIGS. 1 and 2.

Having so described the construction of the pumping arrangement 1 of the present invention as presented in FIG. 3 of the drawing, its operation will now be briefly discussed. As already mentioned before, the electric motor 2 causes the output shaft 4, and with it the mounting element 37 and the fan or impeller 6, to rotate about the longitudinal axis of the output shaft 4. Inasmuch as the eccentric element 36 is centered on its own axis that is transversely offset from the longitudinal axis of the output shaft 4, and the projection 15 prevents the cylinder component 21 from orbiting about the output shaft 4, the force-transmitting element 27 which is mounted on the eccentric element 36 will conduct an oscillating movement which is shared by the ears or lugs 26, the threaded fastening elements 28, the spacing elements 34 and ultimately the cylinder component 21. This oscillating movement is made possible by the aforementioned frusto-conical or similar configuration of the projection 15 of the crankcase 5, in that the projection 15 will not interfere with the movement of the cylinder component 21 as the axis of the cylinder component 21 deviates from the axis of the projection 15 during this oscillating movement. The slope of the straight-line generatrices of the frusto-conical projection 15 advantageously substantially corresponds to the maximum contemplated angle of such deviation. The extent of the stroke of the cylinder component 21 is determined by the eccentricity of the eccentric component 36, while the upper and lower turning points of the stroke and the amount of the angle of deviation of the axis of the piston component 21 with respect to the axis of the projection 15 are determined by the axial length of the spacing elements 34.

As the shaft 4 rotates, the impeller 6 impels the air surrounding the same and causes such air to flow both through the interior of the electric motor stator part 3 and through the crankcase 5, as well as around the exterior of the crankcase 5 and of the electric motor 2, cooling the electric motor 2 and the crankcase 5 in the process. The ambient air caused by the impeller 6 to flow at the exterior of the crankcase 5 flows both around the projection 15 of the crankcase 5 and around the cylinder component 21. Since the cylinder component 21 conducts its oscillating movement simultaneously with the impelling action of the impeller 6, the flow of air at the exterior of the crankcase 5 will be disturbed or obstructed in different ways by the cylinder component 21 as the latter oscillates. Moreover, the relative speed of flow of air around the cylinder component 21 will be increased by the superimposition of the oscillating movement of the cylinder component 21 on the flow of the air impelled by the impeller 6 around the cylinder component 21. Yet, the air flowing around the exterior of the crankcase 5 will also be able to flow around the projection 15 of the crankcase 5, to a greater or lesser extent depending on the momentary position of the cylinder component 21, and thus cool the projection 15. In this manner, there is achieved a considerably improved cooling effect for all of the components of the pumping arrangement 1, especially for the cylinder component 21 and the piston component constituted by the projection 15 and the valve plate 16, so that the sealing element 18 will be subjected to a much lesser degree of wear than in prior-art constructions, due to the lesser degree of thermal loading thereof.

It will be appreciated from the foregoing description and from the consideration of the drawing that the pumping arrangement 1 of the present invention is easily serviceable in the field. As a matter of fact, access to the components which may require field servicing or replacement, such as to the sealing element 18 or the valve elements 58 and 59, can be obtained by merely unthreading or loosening the fastening elements 28 at least to the extent needed for the cylinder component 21 to clear the valve plate 16 and the heads of the connecting elements 17. Thereafter, the cylinder component 21 can be moved aside and the connecting elements 17 and/or the valve plate 16 can be removed if it is necessary to replace any of the valve elements 58 and 59 or the sealing element 18. Moreover, it is also relatively easy to change the volume of the fluid being pumped per unit of time by replacing the mounting member 37 by a different mounting member 37 the central axis of the eccentric element 38 of which has a different offset from the axis of the output shaft 4 than that of the previous mounting member 37 and, if need be for properly positioning the cylinder component 21 on the projection 15 of the crankcase 5, also by replacing the tubular spacing elements 34 by tubular spacing elements 34 of a correspondingly different length.

The pumping arrangement 1 has been described above as including a single projecting portion 7 of the output shaft 2; however, it will be appreciated that, when the above-mentioned additional slave pump part similar or identical to that described above is used in addition to the above-described pump part and is arranged at the opposite axial side of the electric motor 2 from the above-described master pump part, the output shaft 4 of the electric motor 2 is provided with another shaft portion like the shaft portion 7 but projecting from the stator part 3 of the electric motor 2 to such opposite axial side and driving the additional pump part.

While we have described above the principles of our invention in connection with specific apparatus, it is to be clearly understood that this description is made only by way of example and not as a limitation to the scope of our invention as set forth in the objects thereof and in the accompanying claims.

We claim:

1. A pumping arrangement comprising:

a motor having a stator with an open ended axial flow path therethrough and at least one output shaft centered on a longitudinal axis and including at least one shaft portion projecting axially out of said stator;

at least one crankcase stationary with respect to said stator and arranged around said shaft portion;

at least one piston component rigid with and extending outwardly of said crankcase along a reciprocation axis extending substantially normal to said longitudinal axis;

at least one cylinder component arranged around said piston component and cooperating with said piston component to define a pumping chamber;

means for sealing the interface between said piston and cylinder components;

means for admitting a fluid being pumped into and for discharging such fluid from said pumping chamber;

valve means operative for controlling the flow of the fluid being pumped through said admitting and discharging means;

eccentric means mounted on said shaft portion and centered on an eccentric axis substantially parallel to and transversely offset from said longitudinal axis and orbiting said longitudinal axis during the rotation of said shaft portion with attendant eccentric movement of said eccentric means about said longitudinal axis;

said eccentric means having a pair of laterally projecting diametrically opposite ears;, a pair of elongated bolts straddling said crankcase and removably secured in said ears connecting said eccentric means with said cylinder component to cause said cylinder component to share in said eccentric movement of said eccentric means and thus to conduct a reciprocating and tilting oscillating movement with respect to said piston component; and blower means mounted on said shaft portion for joint rotation therewith, said blower means causing ambient air to flow at least around the exterior of said at least one crankcase and through said axial flow path of the stator, thereby effecting cooling of said at least one cylinder and said at least one piston.

2. The pumping arrangement of claim 1 including sleeves surrounding the bolts bottomed on the ears and cylinder to position the cylinder on the piston.

3. The pumping arrangement of claim 1 including a removable head cap on the cylinder receiving the bolts therethrough.

4. The pumping arrangement of claim 1 wherein the blower means is a fan mounted on the shaft outboard from the crankcase and having blades creating an air stream around the crankcase and through the axial flow path of the stator.

5. The pumping arrangement of claim 1 wherein the crankcase has a ring portion embracing and bottomed on an end of the stator and bridge portions connect the ring with an outboard portion of the stator surrounding the bearing.

6. The pumping arrangement of claim 1 wherein the eccentric means includes an element surrounding the shaft with an eccentric periphery and a counterweight portion and an antifriction bearing surrounds the periphery of the eccentric element and a ring carrying said ears surrounds the bearing.

* * * * *